US010626764B2

(12) United States Patent
Xi et al.

(10) Patent No.: US 10,626,764 B2
(45) Date of Patent: Apr. 21, 2020

(54) INTERNAL COMBUSTION ENGINE

(71) Applicant: Shanghai Universoon Auto Parts Co., Ltd., Shanghai (CN)

(72) Inventors: Yong Xi, Shanghai (CN); Zheng Xi, Shanghai (CN)

(73) Assignee: Shanghai Universoon Auto Parts Co., Ltd., Shanghai (CN)

( * ) Notice: Subject to any disclaimer, the term of this patent is extended or adjusted under 35 U.S.C. 154(b) by 0 days.

(21) Appl. No.: 16/375,973

(22) Filed: Apr. 5, 2019

(65) Prior Publication Data

US 2019/0257228 A1 Aug. 22, 2019

Related U.S. Application Data

(63) Continuation of application No. 15/569,453, filed as application No. PCT/IB2015/001755 on Jun. 8, 2015, now Pat. No. 10,329,972.

(30) Foreign Application Priority Data

Apr. 28, 2015 (CN) ..... 2015 1 0210542

(51) Int. Cl.

| | |
|---|---|
| ***F01L 9/02*** | (2006.01) |
| ***F01L 13/06*** | (2006.01) |
| ***F02D 13/04*** | (2006.01) |
| ***F01L 1/08*** | (2006.01) |
| ***F01L 1/18*** | (2006.01) |
| ***F01L 1/26*** | (2006.01) |

(52) U.S. Cl.

CPC ..... *F01L 13/065* (2013.01); *F01L 1/08* (2013.01); *F01L 1/181* (2013.01); *F01L 1/267* (2013.01); *F02D 13/04* (2013.01)

(58) Field of Classification Search

CPC ..... F01L 13/065; F01L 1/267; F01L 1/181; F01L 1/08; F02D 13/04

USPC ..... 123/182.1, 321, 90.12

See application file for complete search history.

(56) References Cited

U.S. PATENT DOCUMENTS 7,909,015 B2 * 3/2011 Yang ..... F02D 13/04 123/321

8,065,987 B2 * 11/2011 Yang ..... F01L 1/08 123/321

* cited by examiner

*Primary Examiner* — Hai H Huynh

(74) *Attorney, Agent, or Firm* — Zhu Lupkowski LLP

(57) ABSTRACT

A single valve compression release bridge brake is provided. The single valve compression release bridge brake includes a braking piston (160) integrated into an inner end of a valve bridge (400) which is located under a rocker arm (210) of an engine. The braking piston (160) is slidably disposed in a braking piston bore (190) opened downwards from the inner end of the valve bridge (400). The lower end of the braking piston (160) is connected to the inner exhaust valve (3001). Oil is supplied to the braking piston bore (190) in the valve bridge (400). The inner end of the valve bridge (400) above the braking piston (160) is pushed upwards against the rocker arm (210) by oil pressure, and a hydraulic linkage is formed between the braking piston (160) and the valve bridge (400). A braking cam lobe (232,233) actuates the rocker arm (210), the inner end of the valve bridge (400), the hydraulic linkage, the braking piston (160), and finally the inner exhaust valve (3001) for the single valve compression release bridge brake.

20 Claims, 4 Drawing Sheets

INTERNAL COMBUSTION ENGINE

This application is a continuation of U.S. patent application Ser. No. 15/569,453, which is the U.S. National Stage of International Application No. PCT/IB2015/001755, filed Jun. 8, 2015, which claims the priority of Chinese Patent Application No. 201510210542.6, filed Apr. 28, 2015.

FIELD OF THE INVENTION

The present application relates to the field of machinery, especially in the field of vehicle engine valve actuation, in particular a single valve compression release bridge brake.

BACKGROUND OF THE INVENTION

There are two types of engine braking: the compression release braking and the bleeder braking. In compression release engine braking, a cam drives an engine exhaust valve to open the valve near the end of the compression stroke of the engine to release the compressed air. The energy absorbed by the compressed air during the compression stroke cannot be returned to the engine piston at the subsequent expansion or "power" stroke of the engine, but is dissipated by the engine exhaust and cooling systems, which results in an effective engine braking and the slow-down of the vehicle.

In addition to the normal exhaust valve opening during the exhaust stroke of the engine cycle, a bleeder brake opens an exhaust valve with a constant and small lift during all the remaining engine cycle (the intake, the compression and the expansion strokes) (full cycle bleeder brake) or during part of the remaining cycle (partial cycle bleeder brake). A bleeder brake is normally not driven by a cam, and must be used with the combination of an exhaust back pressure control device, such as an exhaust butterfly valve. But a compression release brake can be used alone (with no need of an exhaust back pressure control device).

U.S. Pat. No. 7,013,867 discloses a partial cycle bleeder brake system where the outer exhaust valve (away from the cam) is floated open with a small lift near the end of the engine intake stroke by increasing of the exhaust back pressure. The opened exhaust valve is then kept open by a hydraulic piston in the valve bridge with the small lift during the whole compression stroke, and finally closed in the early expansion stroke of the engine. China Patent 201110047127.5 (2014) improved this partial cycle bleeder brake system by integrating the braking bracket into the engine's exhaust rocker arm, reducing space and cost. Still, it is a bleeder brake that has lower engine braking power than a compression release brake, especially at middle to low engine speeds when the exhaust back pressure is low and the floating of the exhaust valve is small or none, which causes low braking or no braking at all. In addition, the valve floating from increasing exhaust back pressure by a butterfly valve or over exhaust flows restriction device could be excess, which leads to uncontrollable seating velocity of the valve and may cause engine damage.

SUMMARY OF THE INVENTION

An object of the present invention is to provide a single valve compression release bridge brake to solve the technical problems in the prior art, such as low engine braking power, excess exhaust valve floating, poor reliability and durability from the above mentioned bleeder brake.

According to one aspect of the present invention, a single valve compression release bridge brake comprises a braking piston integrated into a valve bridge of an engine, the valve bridge being located under one end of a rocker arm of the engine, the other end of the rocker arm having a cam of the engine, the cam comprising at least one braking cam lobe, the valve bridge including an inner end closer to the cam and an outer end farther from the cam, under the inner end of the valve bridge the engine having an inner exhaust valve, and under the outer end of the valve bridge the engine having an outer exhaust valve; and a braking piston bore in the valve bridge, said braking piston being slidably disposed in the braking piston bore, the braking piston bore opening downwards from the inner end of the valve bridge, a lower side of the braking piston being connected to the inner exhaust valve, wherein during engine braking operation, the inner end of the valve bridge above the braking piston being pushed upwards against the rocker arm or a connecting mechanism on the rocker arm by pressure of engine oil in the braking piston bore to form a hydraulic linkage between the braking piston and the inner end of the valve bridge, the braking cam lobe opening the inner exhaust valve through the rocker arm, the inner end of the valve bridge, the hydraulic linkage, and the braking piston for the single valve compression release engine braking.

Further, the cam of the engine also comprises an integrated exhaust cam lobe, the integrated exhaust cam lobe comprising a lower portion and an upper portion, the lower portion having about the same height as the braking cam lobe, and the upper portion being about the same as a traditional exhaust cam lobe.

Further, the at least one braking cam lobe comprises a compression release cam lobe, the compression release cam lobe rising from an inner base circle of the cam during a later period of the engine's compression stroke and reaching its maximum lift near the engine's compression top dead center.

Further, the at least one braking cam lobe comprises an exhaust gas recirculation cam lobe, the exhaust gas recirculation cam lobe rising from an inner base circle of the cam during a later period of the engine's intake stroke and dropping back to or near the inner base circle of the cam during an early period of the engine's compression stroke.

Further, the single valve compression release bridge brake comprises an exhaust lash compensation mechanism, wherein said exhaust lash compensation mechanism forms an exhaust lash in the engine's exhaust valve drive train, the size of the exhaust lash being determined by the braking cam lobe's height.

Further, the single valve compression release bridge brake comprises an oil supply mechanism, wherein said oil supply mechanism comprises an oil supply passage and an oil supply check valve, an outlet of the oil supply passage being connected to the braking piston bore, the oil supply check valve being disposed in the oil supply passage or between the oil supply passage and the braking piston bore, and the oil supply check valve having a flow direction from the oil supply passage into the braking piston bore.

Further, the single valve compression release bridge brake comprises an oil discharging mechanism, wherein said oil discharging mechanism comprises an oil discharging passage and an oil discharging valve, the oil discharging passage connecting the braking piston bore to the outside ambient, and the oil discharging valve being used to open or close the oil discharging passage.

Further, the oil discharging passage comprises an oil discharging hole in the valve bridge at the bottom of the braking piston bore, the oil discharging valve being formed by art outlet of the oil discharging hole and the rocker arm or the connecting mechanism on the rocker arm that acts on the valve bridge and seals the outlet of the oil discharging hole, and the opening or closing of the oil discharging valve being controlled by the change of the distance between the rocker arm and the valve bridge.

Further, the oil discharging passage and the oil discharging valve are both located in the valve bridge, and the opening or closing of the oil discharging valve being controlled by the change of the distance between the valve bridge and the engine.

Further, the connecting mechanism on the rocker arm comprises an e-foot pad and a preloading spring, the preloading spring pushing the e-foot pad against a top surface on the inner end of the valve bridge where the oil discharging hole is located.

Further, the connecting mechanism on the rocker arm comprises a braking lash adjusting mechanism, the braking lash adjusting mechanism being used to set up a braking lash between the cam and the inner exhaust valve, the size of the braking lash being determined by the braking cam lobe's height.

Further, the braking piston in the valve bridge comprises a position limiting mechanism, the positioning limiting mechanism controlling the travel of the braking piston in the braking piston bore.

The present invention is also a method for a single valve compression release bridge braking, which comprises:

- supplying oil to the braking piston bore in the valve: bridge,
- pushing the inner end of the valve bridge above the braking piston upwards against the rocker arm or the connecting mechanism on the rocker arm,
- forming a hydraulic linkage between the braking piston and the inner end of the valve bridge by the oil,
- using the braking cam lobe of the cam to actuate the rocker arm, and
- using the rocker arm then to push the inner end of the valve bridge and the hydraulic linkage as well as the braking piston below to open the inner exhaust valve for the single valve compression release engine braking.

Further, an oil discharging hole is placed in the inner end of the valve bridge at the bottom of the braking piston bore, the oil discharging hole connecting the braking piston bore to the outside ambient, the rocker arm or the connecting mechanism on the rocker arm sitting on and sealing the oil discharging hole, an integrated exhaust cam lobe being designed on the cam, the integrated exhaust cam lobe comprising a lower portion and an upper portion, the lower portion having about the same height as the braking cam lobe, and the upper portion being about the same as a traditional exhaust cam lobe, the method further comprising:

- using the upper portion of the integrated exhaust, cam lobe to push the rocker arm;
- using the rocker arm to push the center of the valve bridge and to move the entire valve bridge downwards;
- separating the inner end of the valve bridge and the rocker arm or the connection mechanism on the rocker arm;
- opening the oil discharging hole in the inner end of the valve bridge to discharge oil from the braking piston bore;
- eliminating the hydraulic linkage between the braking piston and the inner end of the valve bridge;
- the braking piston contacting the valve bridge at the bottom of the braking piston bore; and
- the valve bridge opening both the inner exhaust valve and the outer exhaust valve simultaneously.

The working principle of the present invention is summarized as follows. When engine braking is needed, an oil supply mechanism feeds engine oil into a braking piston bore in an inner end of a valve bridge. Oil pressure pushes the inner end of the valve bridge upwards against a rocker arm or a connecting mechanism in the rocker arm, and a hydraulic linkage is formed between a braking piston in the braking piston bore and the inner end of the valve bridge. A braking cam lobe actuates and opens an inner exhaust valve under the braking piston through the rocker arm, the inner end of the valve bridge, the hydraulic linkage and the braking piston for the single valve compression release engine braking. The rocker arm is further actuated by the upper portion of an integrated exhaust cam lobe that is higher than the braking cam lobe. The rocker arm acts on the center of the valve bridge and drives the entire valve bridge downwards. The inner end of the valve bridge separates from its above rocker arm or the connecting mechanism on the rocker arm, and an oil discharging hole in the inner end of the valve bridge is opened to discharge oil from the braking piston bore. The hydraulic linkage between the braking piston and the valve bridge is eliminated and the valve bridge actuates both the inner exhaust valve and the outer exhaust valve simultaneously.

The present application has positive and significant advantages over the prior art. By integrating the engine braking mechanism into an exist engine valve drive train (the valve bridge), the present invention opens the inner exhaust valve (near the cam) and resets the braking valve lift, which reduces the engine braking load, increases the engine braking power, eliminates any valve floating, and improves the reliability and durability of the engine operation.

DETAILED DESCRIPTION OF THE EMBODIMENTS

First Embodiment

Figure 1:
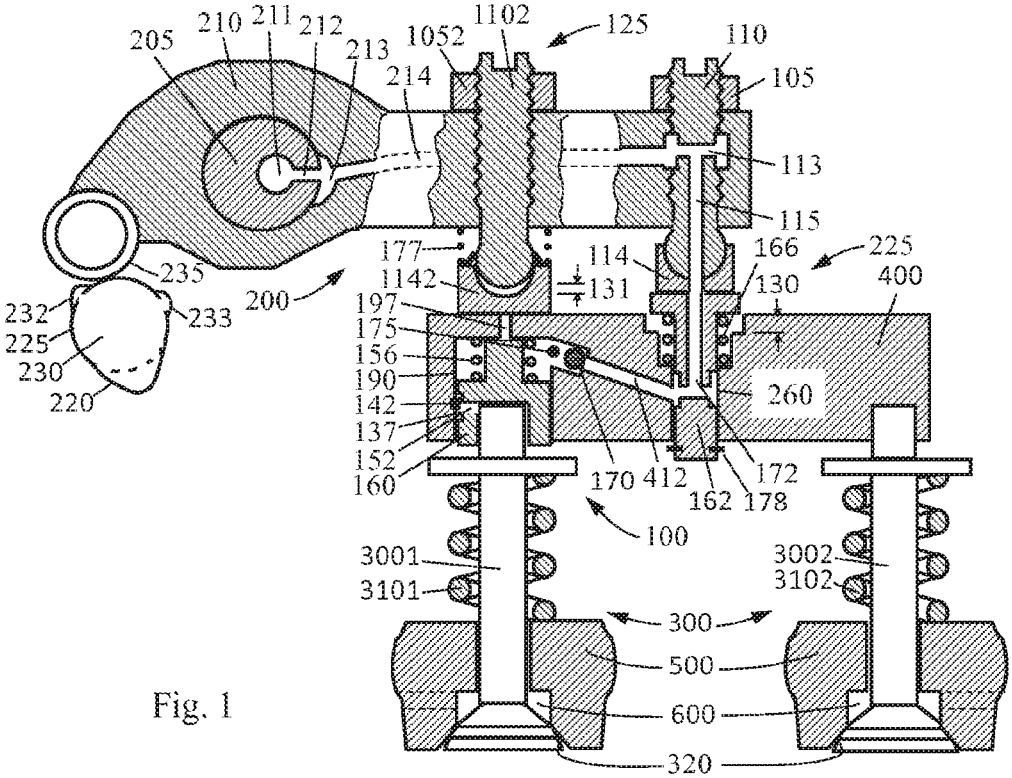
FIG. 1 is a schematic view showing a single valve compression release bridge brake at non-braking state when the cam is at the inner base circle according to the first embodiment of the present invention.
Figure 2:
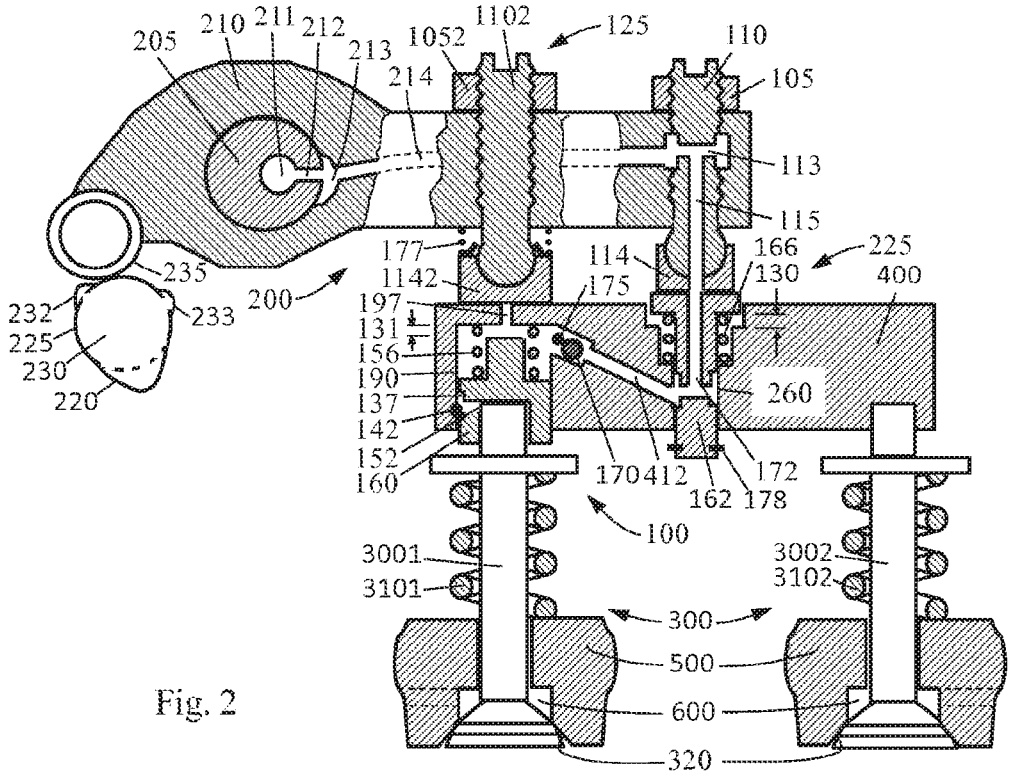
FIG. 2 is a schematic view showing a single valve compression release bridge brake at braking state when the cam is at the inner base circle according to the first embodiment of the present invention.

FIGS. 1 and 2 are used to describe the first embodiment of the single valve compression release bridge brake during non-braking and braking operations when the cam is at the inner base circle according to the present invention. There are three major features showing in the figures: an exhaust valve actuator 200, exhaust valves 300, and an engine braking mechanism 100 integrated into the exhaust valve actuator. Since the engine braking mechanism 100 has a braking piston 160 integrated into a valve bridge 400 of the engine, and opens a single valve for a compression release engine braking, it is called a single valve compression release bridge brake, or simply a bridge brake.

The exhaust valve actuator 200 includes a cam 230, a cam roller 235, a rocker arm 210 and the valve bridge 400. The exhaust valve actuator 200 and the exhaust valves 300 together are called an exhaust valve drive train. The rocker arm 210 is rotationally mounted on a rocker shaft 205. The valve bridge 400 is under one end of the rocker arm 210. The other end of the rocker arm 210 has a cam 230 of the engine. The valve bridge 400 has two ends: an inner end that is near the cam 230 (also under the rocker arm) and an outer end that is away from the cam 230 (not under the rocker arm). As defined herein, the term "inner end" includes the inner extreme and a region near the inner extreme of the valve bridge and the term "outer end" includes the outer extreme and a region near the outer extreme of the valve bridge. Accordingly, the two exhaust valves can be designated as an inner exhaust valve 3001 (near the cam 230) under the inner end of the valve bridge 400, and an outer exhaust valve 3002 (away from the cam 230) under the outer end of the valve bridge 400. A valve lash adjusting system is mounted on the rocker arm 210 above the center of the valve bridge 400, which includes a lash adjusting screw 110 that has its top fixed on the rocker arm 210 by a lock nut 105 and its bottom engaged with an e-foot pad 114.

The inner exhaust valve 3001 and outer exhaust valve 3002 (referred to as exhaust valves 300) are held against valve seats 320 in the engine cylinder overhead 500 by valve springs 3101 and 3102 respectively to prevent gases (air during engine braking) from flowing between an engine cylinder and an exhaust port 600. During a normal engine power operation, the exhaust valve actuator 200 transmits the motion of an exhaust cam lobe 220 on the cam 230 at one end of the rocker arm 210 to the two exhaust valves 300 (the inner and outer exhaust valves 3001 and 3002) on the other end of the rocker arm simultaneously through a roller 235 (could also be a pushtube of a pushtube engine), the rocker arm 210 and the valve bridge 400, which makes the two exhaust valves open and close periodically.

The cam 230 of the engine according to the present invention has at least one braking cam lobe, shown in FIGS. 1 and 2 including a compression release (CR) cam lobe 233 and an exhaust gas recirculation (EGR) cam lobe 232 on the inner base circle 225. The cam 230 also includes an integrated exhaust cam lobe 220 that has a lower portion and an upper portion (See FIG. 3 for details). The lower portion has about the same height as the braking cam lobe 232 or 233, and the upper portion is about the same as a traditional exhaust cam lobe (only for engine power operation, no engine braking operation).

The bridge brake 100 includes a braking piston 160 integrated into the valve bridge 400, which is slidably disposed in a braking piston bore 190 opened downwards from the inner end of the valve bridge 400. The lower side of the braking piston 160 is connected to the inner exhaust valve 3001. The inner end of the valve bridge above the braking piston 160 is pushed upwards against the rocker arm 210 or a connecting mechanism 125 on the rocker arm by pressure of engine oil introduced into the Making piston bore 190 (see FIG. 2). A hydraulic linkage is formed with a liquid column height 131 between the braking piston 160 and the valve bridge 400. The braking cam lobe 232 or 233 opens the inner exhaust valve 3001 through the rocker arm 210, the inner end of the valve bridge 400, the hydraulic linkage, and the braking piston 160 for the single valve compression release engine braking.

At the center of the valve bridge 400 there is an exhaust lash compensation mechanism 225 that includes a lash compensation piston 162 and a lash compensation spring 166 (also known as anti-no-follow spring). The lash compensation piston 162 is slidably disposed in a lash compensation piston bore 260 in the center of the valve bridge 400. The exhaust lash compensation mechanism 225 forms a lash 130 in the exhaust valve drive train, and the size of the exhaust lash is determined by the height of the braking cam lobes 232 and 233 (approximately the height of the braking cam lobes multiplied by an exhaust rocker ratio). The anti-no-follow spring 166 is to prevent no-follow of any exhaust valve drive train component due to the exhaust lash 130 and could be a different type, such as a flat spring, and at a different location, such as over the rocker arm. A clip ring 178 on the lower part of the exhaust lash compensation piston 162 is used to keep the piston from falling out of the bore.

The bridge brake 100 also has an oil supply mechanism that includes an oil supply passage and an oil supply check valve. The oil supply passage includes an axial hole 211 and a radial hole 212 in the rocker shaft 205, a cut or groove 213 and an oil hole 214 in the rocker arm 210, a horizontal hole 113 and a vertical hole 115 (connected to a hole in the e-foot pad 114) in the lash adjusting screw 110, a hole 172 in the lash compensation piston 162 and a passage 412 in the valve bridge 400. The outlet of an oil supply passage is connected to the braking piston bore 190. The oil supply check valve 170 is disposed in an oil supply passage or between the braking piston bore 190 and an oil supply passage. The flow direction of the oil supply check valve 170 is from the oil supply passage to the braking piston bore 190.

The bridge brake 100 also has an oil discharging mechanism that includes an oil discharging passage and an oil discharging valve. The oil discharging passage connects the braking piston bore 190 to the outside ambient, and the oil discharging valve opens and closes the oil discharging passage. The oil discharging passage shown in FIGS. 1 and 2 is an oil discharging hole or orifice 197 in the valve bridge at the bottom of the braking piston bore 190. The oil discharging valve is formed by the outlet or exit of the oil discharging hole 197 and the rocker arm 210 or the connecting mechanism 125 on the rocker arm that presses against the valve bridge 400 and seals the oil discharging hole 197. The opening or closing of the oil discharging valve is controlled by the change of distance between the rocker arm 210 and the valve bridge 400. In addition, the oil discharging passage and the oil discharging valve can also be placed in the valve bridge 400, and the opening or closing of the oil discharging valve is then controlled by the change of distance between the valve bridge 400 and the engine.

The connecting mechanism 125 on the rocker arm 210 over the inner end of the valve bridge 400 is also a braking lash adjusting mechanism, including an e-foot pad 1142 and a preloading spring 177. The e-foot pad 1142 is attached to a pressed-in spherical head on the bottom end of an adjusting screw 1102 that is fixed on the rocker arm 210 by a nut 1052. The e-foot pad 1142 is pushed by the preloading spring 177 against the top surface on the inner end of the valve bridge 400 where the oil discharging hole 197 is located, which seals the oil discharging hole 197. The size of the braking lash 131 between the e-foot pad 1142 and the adjusting screw 1102 shown in FIG. 1 is determined by the braking cam lobes 232 and 233 (approximately the height of the braking cam lobes multiplied by a braking rocker ratio).

The braking piston 160 in the valve bridge 400 has a positioning mechanism to limit the travel of the braking piston in the braking piston bore 190, which includes a positioning pin 142 fixed in the valve bridge 400 and a positioning groove or cut 137 on the braking piston 160. A spring 156 can be placed between the braking piston 160 and the valve bridge 400 to lower the braking activation oil pressure. In the present embodiment, a pressure relief mechanism is also provided within the valve bridge 400, which includes a bleeding orifice 152 on the braking piston 160. When the oil pressure in the braking piston bore 190 increases, the oil leakage through the annular gap between the braking piston 160 and the bore 190 also increases, which makes the oil pressure on the braking piston 160 not to exceed a predetermined value.

When engine braking is needed, the oil supply mechanism through oil supply passages and oil supply check valve feeds oil into the braking piston bore 190 in the bridge brake 100. The inner end of the valve bridge above the braking piston 160 is pushed upwards by oil pressure against the rocker arm 210 or the connecting mechanism 125 on the rocker arm to take up the braking lash 131 between the e-foot pad 1142 and adjusting screw 1102. A hydraulic linkage with a liquid column 131 between the braking piston 160 and the valve bridge 400 is formed. The braking cam lobe 232 or 233 of the cam 230 rises from the inner base circle 225 and pushes the rocker arm 210 to rotate around the rocker shaft 205 clockwise, pushing the connecting mechanism 125, the inner end of the valve bridge, the hydraulic linkage and the braking piston 160 below to open the inner exhaust valve 3001 for the single valve compression release engine braking. Due to the exhaust lash 130 formed by the exhaust lash compensation mechanism located in the center of the valve bridge 400, the motion of the braking cam lobe 232 or 233 will not be transmitted to the exhaust valves through the center of the valve bridge, and the outer exhaust valve 3002 remains closed during the engine braking operation.

The single valve compression release bridge brake of the present invention has unique advantages. Because the braking rocker ratio at the inner exhaust valve 3001 is far smaller than the exhaust rocker ratio at the center of the valve bridge, the contact stresses at the cam and at the rocker arm are greatly reduced by opening the inner exhaust valve for braking according to the present invention, which improves the reliability and durability of the engine, especially of the cam mechanism and the rocker arm mechanism.

When the upper portion (similar to 220*b* in FIG. 3) of the integrated exhaust earn lobe 220 of the cam 230 actuates the rocker arm 210, the exhaust lash 130 at the center of the valve bridge 400 in FIGS. 1 and 2 is zero. The rocker arm 210 pushes the center of the valve bridge and the entire valve bridge 400 moves downwards. The inner end of the valve bridge separates from its above rocker arm 210 or the connection mechanism 125 on the rocker arm. The oil discharging hole 197 in the inner end of the valve bridge is opened to discharge oil. The hydraulic linkage between the braking piston 160 and the valve bridge 400 is eliminated and the liquid column 131 in FIG. 2 becomes zero. The braking piston 160 is in contact with the valve bridge 400 at the bottom of the braking piston bore 190. The valve bridge 400 now drives both inner exhaust valve 3001 and the outer exhaust valve 3002 simultaneously, and the motion of the upper portion of the integrated exhaust cam lobe 220 is transmitted to the two exhaust valves, generating a braking valve lift with resetting (of the inner exhaust valve).

When engine braking is not needed, the oil supply mechanism stops feeding oil to the bridge brake 100. The hydraulic linkage (the liquid column 131 in FIG. 2) between the braking piston 160 and the valve bridge 400 is eliminated by the oil discharging mechanism and cannot be re-established. Exhaust lashes 130 (between the rocker arm 210 and the center of the valve bridge) and 131 (between the rocker arm 210 and the inner end of the valve bridge) are formed respectively as shown in FIG. 1. The motions from the braking cam lobes 232 and 233 as well as the lower portion (220*a* in FIG. 3) of the integrated exhaust cam lobe 220 are not passed to the exhaust valves 300. Only the motion of the upper portion (similar to 220*b* in FIG. 3) of the integrated exhaust cam lobe 220 is transmitted to the exhaust valves 300 for the same traditional engine power exhaust valve motion, while the engine braking operation is disabled.

Figure 3:
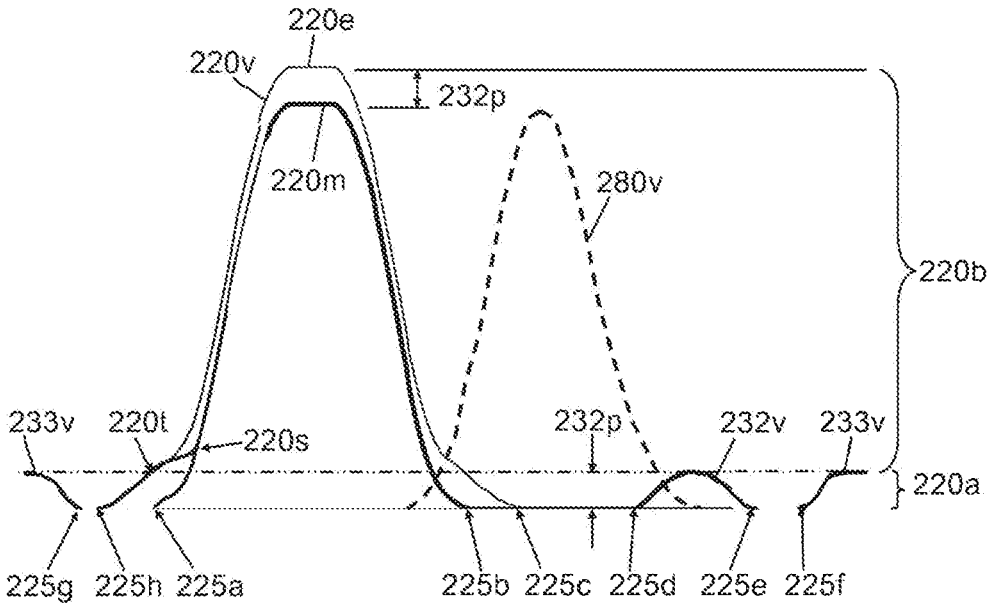
FIG. 3 is a schematic diagram showing valve lift profiles for a single valve compression release bridge brake according to the present invention.

FIG. 3 shows a set of valve lift profiles for single valve compression release bridge brake of the present application which includes exhaust valve lift profiles generated by the braking cam lobes 232 and 233 as well as the integrated exhaust cam lobe 220. A traditional engine exhaust valve lift profile 220*m* has a starting point 225*a*, an end point 225*b*, and a maximum lift 220*b*. If there were no exhaust lash at the center of the valve bridge, an enlarged main valve lift profile 220*v* generated by the integrated exhaust cam lobe 220 would have a starting point 225*h*, an end point 225*c*, and a maximum lift 220*e* which is a summation of 220*a* and 220*b*. Due to a valve lift resetting generated by the oil discharge mechanism, the valve lift profile of the inner exhaust valve 3001 for engine braking begins to transit to the main valve lift profile 220*m* at a transitional point 220*t* between the lower portion 220*a* and the upper portion 220*b* of the enlarged main valve lift profile 220V, merges into the main valve lift profile 220*m* at a point 220*s*, and closes at the end point 225*b* earlier than without the resetting.

During the engine braking operation, the motions of the braking cam lobes (i.e. the small cam lobes 232 and 233) of the cam 230 are transmitted to the inner exhaust valve 3001 under the brake piston 160 (as shown in FIG. 2) by the rocker arm 210 or the connecting mechanism 125 on the rocker arm, the hydraulic linkage and the brake piston 160 below, producing a braking valve lift profile 232*v* for exhaust gas recirculation and 233*v* for compression release as shown in FIG. 3. The brake valve lift profile 232*v* for exhaust gas recirculation has a starting point 225*d* located in a later period of the intake stroke of the engine, that is, near a place when an intake valve profile 280*v* ends. The brake valve lift profile 232*v* for exhaust gas recirculation has an end point 225*e* located in an earlier period of the compression stroke of the engine. The brake valve lift profile 233*v* for compression release has a starting point 225*f* located in a later period of the compression stroke of the engine, and an end point 225*g* located in an earlier period of the expansion stroke of the engine. The valve lift profile recycles between 0° to 720°, wherein 0° and 720° are the same point.

When the integrated exhaust cam lobe 220 of the cam 230 rises from the inner base circle 225 (FIG. 2), the rocker arm 210 of the connecting mechanism 125 on the rocker arm pushes the inner end of the valve bridge, the hydraulic linkage 131 and the brake piston 160 below (FIG. 2) to open the inner exhaust valve 3001 below the braking piston 160, generating a transitional portion of valve lift from 225*h* to 220*t* as shown in FIG. 3. When the earn 230 rotates into the upper portion of the integrated exhaust cam lobe 220 (which is greater than the maximum lift 232*p* of the braking cam lobes 232 and 233 as shown in FIG. 3), the exhaust lash between the rocker arm 210 and the center of the valve bridge is zero. The rocker arm 210 pushes the center of the valve bridge and the entire valve bridge 400 is moved downwards. The inner end of the valve bridge separates from the rocker arm 210 or the connecting mechanism 125 on the rocker. The oil discharging passage 197 is opened to discharge oil. The hydraulic linkage between the braking piston 160 and the valve bridge 400 is eliminated. The braking inner exhaust valve 3001 get into contact with the valve bridge 400, and its lift profile transits to the main valve lift profile 220*m* after the transitional point 220*t* (as shown in FIG. 3), and ends at the end point 225*b* which is significantly ahead of the end point 225*c* in the case without the resetting. In this way, the exhaust valve lift at the top dead center in the engine exhaust stroke is reduced, which avoids the collision between the exhaust valve 3001 and the engine piston, and also increases the braking power and reduces the temperature inside the cylinder.

Second Embodiment

Figure 4:
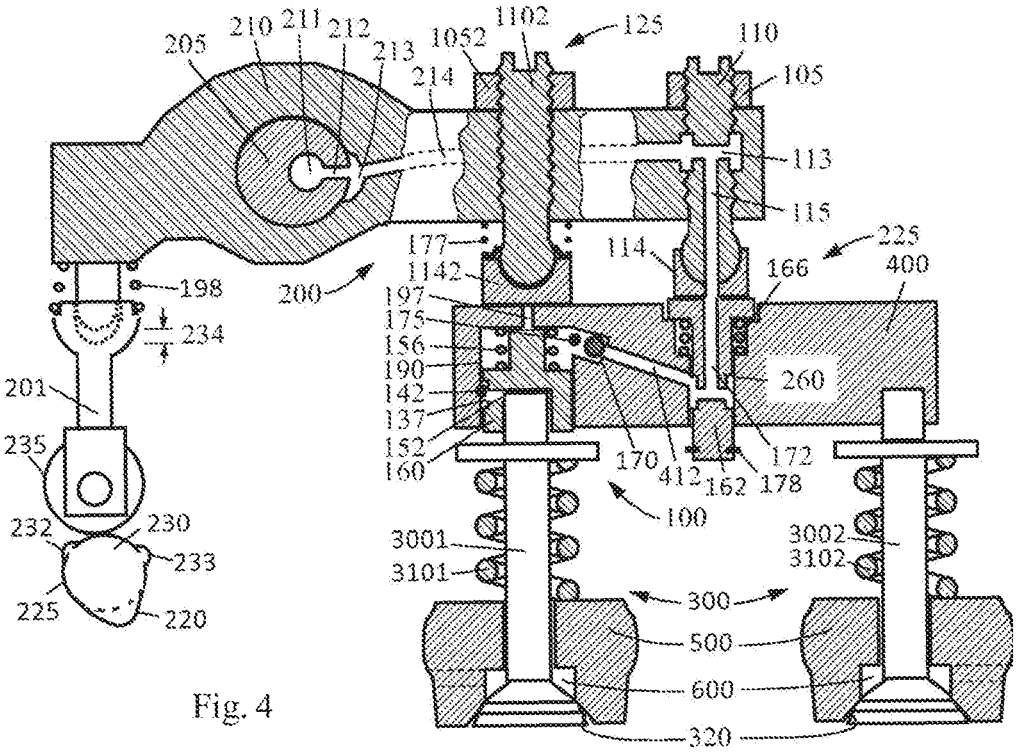
FIG. 4 is a schematic view showing a single valve compression release bridge brake at non-braking state when the cam is at the inner base circle according to the second embodiment of the present invention.
Figure 5:
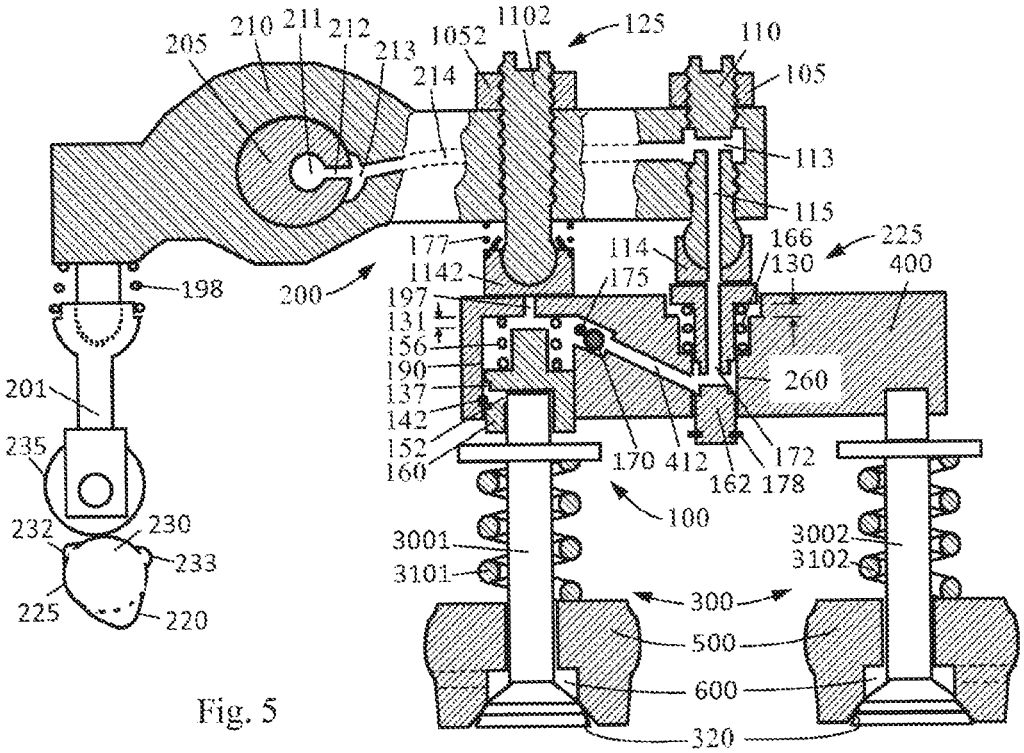
FIG. 5 is a schematic view showing a single valve compression release bridge brake at braking state when the cam is at the inner base circle according to the second embodiment of the present invention.

FIGS. 4 and 5 are used to describe the second embodiment of the single valve compression release bridge brake during non-braking and braking operations when the cam is at the inner base circle according to the present invention. The difference between the present embodiment and the first embodiment is that the present embodiment is for a pushtube engine. The exhaust lash 130 at the center of the valve bridge in FIG. 1 for the first embodiment is moved to the pushtube side as 234 in FIG. 4 for the second embodiment. A lash compensation spring (also known as an anti-no-follow spring) 198 is also added between the pushtube 201 and the rocker arm 210 to bias the rocker arm against the valve bridge 400. Actually, the exhaust lash of the present embodiment can also be placed at the center of the valve bridge, which will causes the valve lash compensation piston 162 to reciprocate frequently in the lash compensation piston bore 260 during engine power operation.

The engine braking operation of the present embodiment is the same as the first embodiment and won't be repeated here for simplicity.

Third Embodiment

Figure 6:
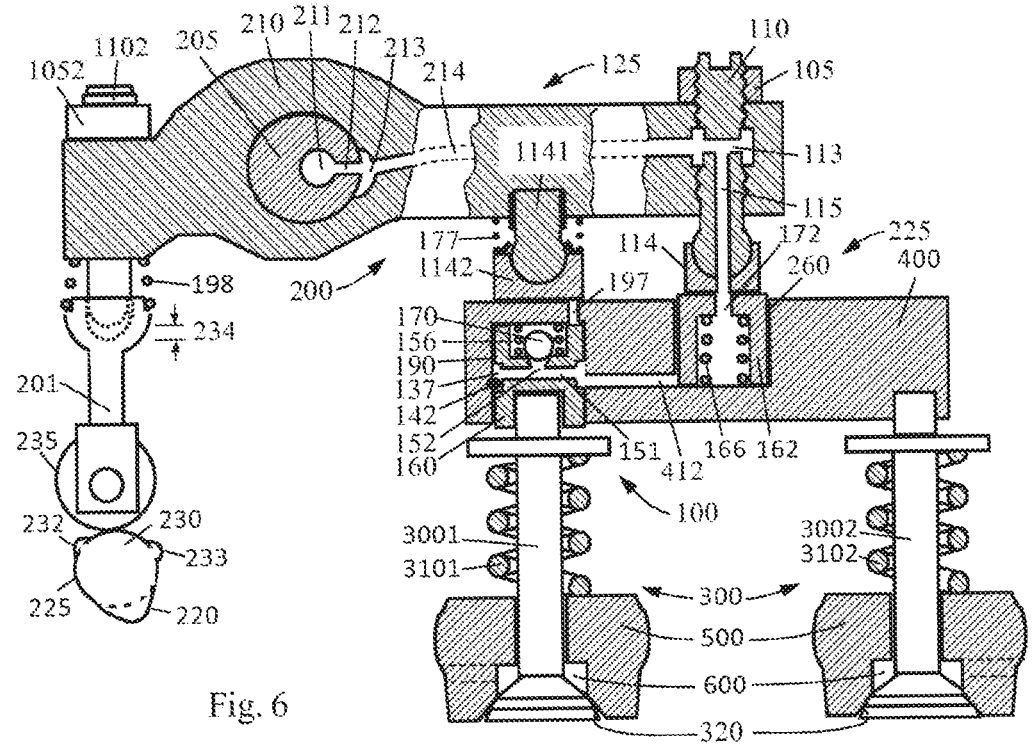
FIG. 6 is a schematic view showing a single valve compression release bridge brake at non-braking state when the cam is at the inner base circle according to the third embodiment of the present invention.
Figure 7:
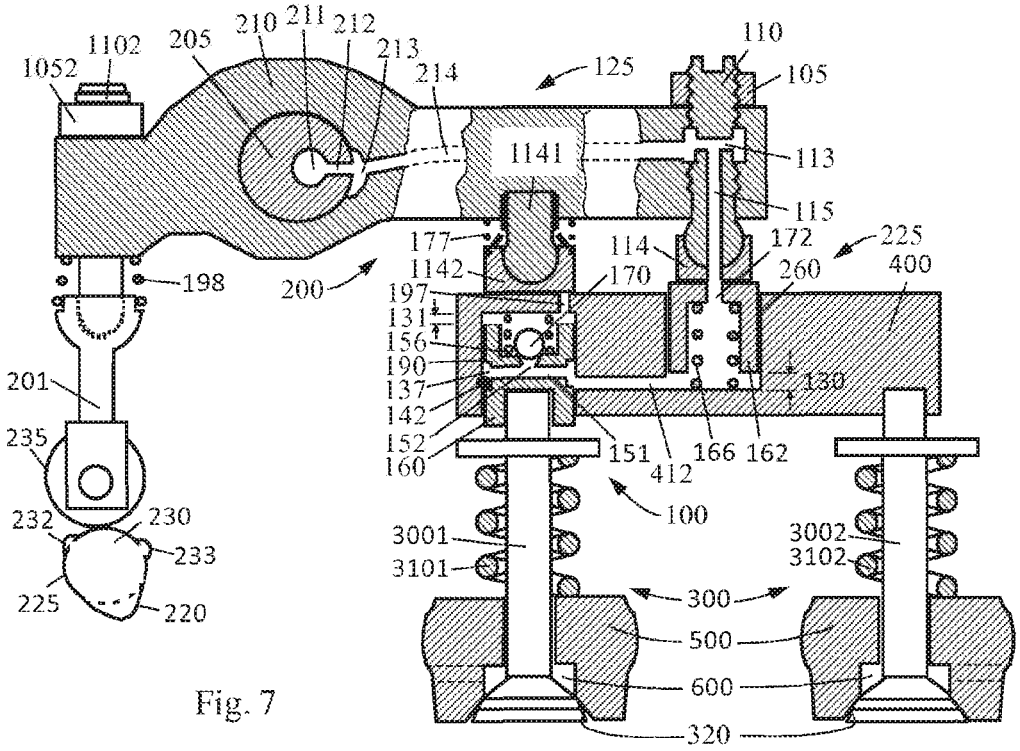
FIG. 7 is a schematic view showing a single valve compression release bridge brake at braking state when the cam is at the inner base circle according to the third embodiment of the present invention.

FIGS. 6 and 7 are used to describe the third embodiment of the single valve compression release bridge brake during non-braking and braking operations when the cam is at the inner base circle according to the present invention. Like the second embodiment, the present embodiment is also for a pushtube engine. However, there are four major differences between the present embodiment and the second embodiment. First, a different exhaust lash compensation piston 162 is used in the center of the valve bridge. Second, a different braking piston 160 is used in the braking piston bore 190 at the inner end of the valve bridge. Third, the oil supply check valve 170 is placed at an outlet 152 of an oil supply passage 151 in the braking piston 160. Fourth, the braking lash adjust mechanism is moved to the pushtube side, and the exhaust lash 234 shown in FIG. 6 is on the pushtube side, which means that the preload of the anti-no-follow spring 198 is higher than that from springs 156 and 166.

When engine oil is supplied to the braking piston bore 190 through the oil supply passages 211, 212, 213, 214, 113, 115, 172, 412, and 151, oil passes the oil supply check valve 170 and pushes the inner end of the valve bridge upwards against the e-foot pad 1142 of the connecting mechanism 125 on the rocker arm 210 as shown in FIG. 7. A hydraulic linkage with a liquid column 131 is formed between the braking piston 160 and the inner end of the valve bridge due to the hydraulic lock created by the oil supply check valve 170 and the sealed oil discharging hole or passage 197. Note that there is no hydraulic linkage between the exhaust lash compensation piston 162 and the valve bridge 400 because the liquid column 130 will flow back and out of the piston bore 260 through the oil supply passages when the exhaust lash compensation piston 162 is pushed down in the valve bridge 400. An accumulator may be needed in the oil supply mechanism to accommodate the oil pushback.

The engine braking operation of the present embodiment is also the same as the first embodiment and won't be repeated here for simplicity.

Fourth Embodiment

The present embodiment is a further simplification from all the above embodiments. The oil to the braking piston bore 190 at the inner end of the valve bridge 400 does not come from the oil supply passages 172 and 412 in the lash compensation piston 162 and the valve bridge 400, but directly from the connecting mechanism 125 (oil supply passages added inside) on the rocker arm 210. The inner end of the valve bridge includes not only the oil discharging hole 197, but also an oil supply passage and an oil supply check valve. The oil supply check valve could be also be set in the oil supply passage in the connecting mechanism 125. The operation of the present embodiment is also the same as the first embodiment and won't be repeated here.

While the above description contains many specific embodiments, these embodiments should not be regarded as limitations on the scope of the present invention, but rather as specific exemplifications. Many other variations are likely to be derived from the specific embodiments. For example, the exhaust lash compensation mechanism could have different designs and arrangements. The shape, size, and location of the lash compensation piston as well as the number, size, shape and location of the lash compensation spring are adjustable if needed to serve the purpose of forming an exhaust lash for lost motion in the exhaust valve drive drain without any no-follow due to the exhaust lash. Also, the oil supply mechanism could be different, including a two-position and three-way solenoid valve or a two-position and two-way solenoid valve, and the oil supply check valve could also have different types and installment locations to serve the purpose of feeding oil into the braking piston bore in the inner end of the valve bridge to form a hydraulic linkage between the braking piston and the inner end of the valve bridge.

In addition, the oil discharging valve of the oil discharging mechanism remains to be closed when a braking cam lobe or the lower portion of the integrated exhaust cam lobe actuates on the rocker arm and the inner end of the valve bridge. The oil discharging valve of the oil discharging mechanism opens to discharge oil when the upper portion of the integrated exhaust cam lobe actuates on the rocker arm and the center of the valve bridge. Not only the oil discharging valve can be formed by the oil discharging passage in the valve bridge and the rocker arm or the connecting mechanism on the rocker arm, other types of oil discharging mechanism can also be used, such as that with both the oil discharging passage and oil discharge valve located in the valve bridge, and the opening and closing of the oil discharging valve is controlled by the change of the distance between the valve bridge and the engine.

In addition, the connecting mechanism on the rocker arm could have different types, for example, using, a non-adjustable pressed-in spherical head and an e-foot pad combination with a preloading spring between the pressed-in spherical head and the e-foot pad, and the distance between them (braking lash) is adjustable according to need.

In addition, the braking piston could have different types, such as the "H" type and "T" type. It could also subject to different spring preloads, including no preload at all. Therefore, the scope of the present invention should not be defined by the above-mentioned specific examples, but by the appended claims.

What is claimed is:

1. An internal combustion engine comprising:

a rocker arm having a first end portion, a second end portion, and a third portion between the first and second end portions;

a cam positioned to engage the first end portion of the rock arm;

a valve bridge that includes a first end portion and a second end portion, wherein the third portion of the rocker arm is positioned to engage the first end portion of the valve bridge;

a cylinder having a first exhaust valve and a second exhaust valve that open or close the cylinder;

a braking piston slidably disposed in the first end portion of the valve bridge, wherein during engine braking operation, engine oil is supplied in the valve bridge so that the first end portion of the valve bridge is raised towards the third portion of the rocker arm so that the first end portion of the valve bridge engages the third portion of the rocker arm for engine braking operation, and the cam actuates the first exhaust valve for engine braking operation through a connection that comprises the rocker arm, the first end portion of the valve bridge, the engine oil, and the braking piston.

2. The internal combustion engine according to claim 1, wherein the cam actuates only the first exhaust valve, but not the second exhaust valve, for engine braking operation.

3. The internal combustion engine according to claim 2, further comprising a connecting mechanism that is mounted in the third portion of the rocker arm, wherein the first end portion of the valve bridge engages the third portion of the rocker arm through the connecting mechanism, and wherein during engine braking operation, the connection comprises the connecting mechanism.

4. The internal combustion engine according to claim 3, wherein the connecting mechanism includes an adjusting screw and a nut.

5. The internal combustion engine according to claim 3, wherein the connecting mechanism includes a braking lash adjusting mechanism.

6. The internal combustion engine according to claim 5, wherein the braking lash adjusting mechanism comprises an adjusting screw, a nut, an e-foot pad and a preloading spring, wherein the e-foot pad is connected to the adjusting screw and is pushed by the preloading spring against the first end portion of the valve bridge.

7. The internal combustion engine according to claim 6, wherein the first end portion of the valve bridge includes a discharging hole that is able to discharge the engine oil, and wherein when the e-foot pad is pushed by the preloading spring against the first end portion of the valve bridge, the e-foot pad seals the discharging hole to prevent the engine oil from being discharged.

8. The internal combustion engine according to claim 7, further comprising a discharging valve, where the oil discharging valve opens or closes the discharging passage.

9. The internal combustion engine according to claim 8, wherein the discharging valve is formed by the connecting mechanism contacting the valve bridge to seal the discharging hole, and the opening or closing of the discharging valve being controlled by the change of the distance between the connecting mechanism and the valve bridge.

10. The internal combustion engine according to claim 9, further comprising an oil supply mechanism that comprises an oil supply passage and an oil supply check valve, an outlet of the oil supply passage being connected to a braking piston bore in which the braking piston is disposed, the oil supply check valve being disposed in the oil supply passage or between the oil supply passage and the braking piston bore, and the oil supply check valve having a flow direction from the oil supply passage into the braking piston bore.

11. The internal combustion engine according to claim 2, wherein the cam comprises at least one braking cam lobe that actuates the first exhaust valve for engine braking operation.

12. The internal combustion engine according to claim 11, wherein said at least one braking cam lobe comprises a compression release cam lobe, the compression release cam lobe rising from an inner base circle of the cam during a later period of the engine's compression stroke and reaching its maximum lift near the engine's compression top dead center.

13. The internal combustion engine according to claim 11, wherein said at least one braking cam lobe comprises an exhaust gas recirculation cam lobe, the exhaust gas recirculation cam lobe rising from an inner base circle of the cam during a later period of the engine's intake stroke and dropping back to or near the inner base circle of the cam during an early period of the engine's compression stroke.

14. The internal combustion engine according to claim 2, further comprising an exhaust valve drive train including an exhaust lash compensation mechanism disposed in a middle portion of the valve bridge.

15. The internal combustion engine according to claim 14, wherein the exhaust lash compensation mechanism includes a lash compensation piston and a lash compensation spring, wherein the lash compensation piston is slidably disposed in a lash compensation piston bore in the middle portion of the valve bridge.

16. The internal combustion engine according to claim 14, wherein said exhaust lash compensation mechanism forms the exhaust lash in the exhaust valve drive train, the size of the exhaust lash being determined by the braking cam lobe's height.

17. An internal combustion engine comprising:

a rocker arm having a first end portion, a second end portion, and a third portion between the first and second end portions;

a cam positioned to engage the first end portion of the rock arm;

a valve bridge that includes a first end portion and a second end portion, wherein the third portion of the rocker arm is positioned to engage the first end portion of the valve bridge;

a cylinder having a first exhaust valve and a second exhaust valve that open or close the cylinder;

a piston slidably disposed in the first end portion of the valve bridge, wherein engine oil is supplied in the valve bridge so that the first end portion of the valve bridge is raised towards the third portion of the rocker arm so that the first end portion of the valve bridge engages the third portion of the rocker arm, and the cam actuates the first exhaust valve through a connection that comprises the rocker arm, the first end portion of the valve bridge, the engine oil, and the piston.

18. The internal combustion engine according to claim 17, wherein the cam actuates only the first exhaust valve, but not the second exhaust valve.

19. The internal combustion engine according to claim 18, further comprising a connecting mechanism that is mounted in the third portion of the rocker arm, wherein the first end portion of the valve bridge engages the third portion of the rocker arm through the connecting mechanism, and the connection comprises the connecting mechanism.

20. The internal combustion engine according to claim 19, wherein the connecting mechanism includes a lash adjusting mechanism.

* * * * *